United States Patent [19]

Sewell et al.

[11] 3,971,932

[45] July 27, 1976

[54] APPARATUS FOR ENHANCING THE LONG WAVELENGTH RESPONSE OF PHOTODETECTORS

[75] Inventors: Kenneth G. Sewell, Dallas; William B. Volz, Richardson, both of Tex.

[73] Assignee: Varo, Inc., Garland, Tex.

[22] Filed: Dec. 2, 1974

[21] Appl. No.: 528,806

[52] U.S. Cl. ..... 250/213 VT; 313/388

[51] Int. Cl.[2] ..... H01J 31/50

[58] Field of Search ..... 250/213 R, 339, 213 VT, 250/211 R; 313/373, 375, 380, 384, 386, 388; 338/15, 17, 18

[56] References Cited

UNITED STATES PATENTS

| | | | |
|---|---|---|---|
| 3,213,308 | 10/1965 | Feibelman | 313/380 |
| 3,569,763 | 3/1971 | Kiuchi et al. | 250/213 VT |
| 3,663,821 | 5/1972 | Finkle | 313/388 |
| 3,800,194 | 3/1974 | Maruyama et al. | 250/213 R |
| 3,870,921 | 3/1975 | Burns | 250/213 VT |

*Primary Examiner*—Alfred E. Smith
*Assistant Examiner*—D. C. Nelms
*Attorney, Agent, or Firm*—Olson, Trexler, Wolters, Bushnell & Fosse

[57] ABSTRACT

A photodetection device includes a photosensor usefully responsive to electromagnetic energy of a first band of wavelengths. An energy conversion unit is optically coupled to the photosensor for receiving incident electromagnetic energy of different, longer wavelength and emitting, in response, electromagnetic energy within the band of first wavelengths.

12 Claims, 3 Drawing Figures

APPARATUS FOR ENHANCING THE LONG WAVELENGTH RESPONSE OF PHOTODETECTORS

BACKGROUND OF THE INVENTION

This invention relates generally to photodetection apparatus and more particularly to means for providing such apparatus with acuity regarding relatively long wavelength light.

Sensitivity, that is, the ability to develop useful information from weak signals, is a desirable characteristic of photodetectors, particularly those of the image-forming type. However, the photodetectors of the prior art display decreasing spectral sensitivity at regions away from the wavelength of peak spectral sensitivity. An example of this is found in military night vision equipment which can sense and provide an image of a target weakly illuminated by ambient or by a conventional infrared searchlight but which cannot "see," or may even be damaged by, incident infrared laser light.

It is therefore an important object of this invention to provide photodetection apparatus which is highly sensitive to a given, narrow band of electromagnetic radiation but which is capable of providing useful information regarding one or more spectrally different radiations.

A more general object of the invention is to provide new and improved photodetection apparatus.

A more specific object of the invention is to provide night vision equipment having laser sensitivity.

These and other objects and features of the invention will become more apparent from a consideration of the following descriptions.

BRIEF DESCRIPTION OF THE DRAWING

The invention, both as to its construction, and its mode of operation, will be better understood by reference to the following disclosure and drawing forming a part thereof, wherein.

DESCRIPTION OF THE ILLUSTRATED EMBODIMENTS

Figure 1:
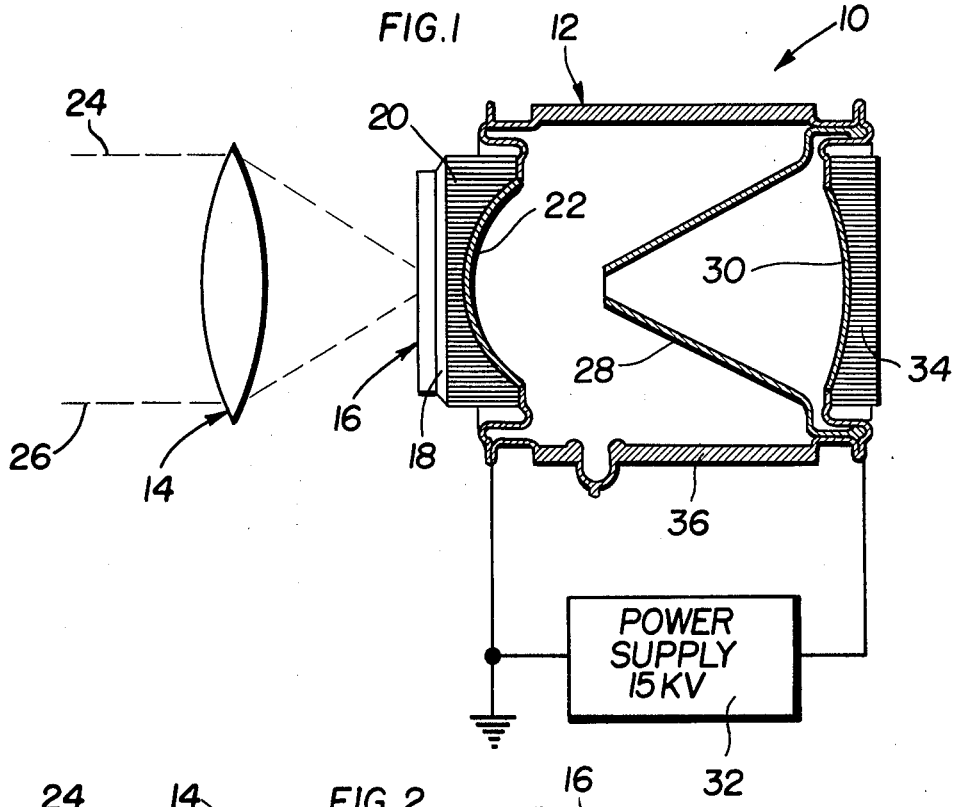
FIG. 1 is a schematic view of photodetection apparatus constructed in compliance with the present invention and including an image intesifier tube.

Referring now in detail to the drawing, specifically to FIG. 1, photodetection apparatus useful as night vision equipment is indicated generally by the reference numeral 10. Apparatus 10 comprises a photosensor 12 which takes the form of a conventional image intensifier tube, a collecting lens 14, and an energy converter 16 which is disposed between the collecting lens 14 and the photosensor 12. The energy converter 16 is mounted on the photosensor 12 in optically coupled relationship by means of an annular bead 18 of a suitable cement or adhesive.

The image intensifier tube which comprises the photosensor 12 includes a fiber optic faceplate 20 and a layer 22 of photoemissive material deposited on the inner surface of the faceplate 20 to form a photocathode. Radiation from a target area is shown by the lines 24 and 26; and this incident radiation is collected as an image by the lens 14, this image being ultimately coupled through the fiber optic faceplate 20 onto the photocathode 22 which emits electrons in quantities determined by its own spectral sensitivity and the wavelengths of the received radiation. The electrons emitted by the photocathode 22 are focused by means of an electron optics device 28 onto a screen 30 of phosphor material. In accordance with conventional practice, an accelerating voltage from a power supply 32 is applied between the screen 30 and the photocathode 22 to increase the energy of the flowing electrons. Power supplies having a nominal accelerating potential of 15 kilovolts are useful for this purpose.

The electrons from photocathode 22 which strike the screen 30 excite the phosphor material producing optical photons; and these photons are coupled out of the image intensifier tube by means of a fiber optics bundle 34 upon which the screen 30 is deposited. As will be appreciated, the intensified optical image at the exit of the fiber optics bundle 34 may be further amplified, viewed directly, or processed by a number of standard means.

The photosensor which comprises the image intensifier tube includes a housing or envelope 36 which properly positions the faceplate 20, the photocathode 22, the electron optics 28, the screen 30, and the fiber optics bundle 34.

In the circumstances wherein the photocatode 22 is a conventional S-20 photocathode, the spectral sensitivity, as measured in microamperes per watt, has a maximum value corresponding to a wavelength of about 0.66 microns. In addition, the spectral sensitivity of such a photocathode decreases rapidly with increasing wavelength, and such a photocathode is generally considered insensitive to wavelengths greater than 0.950 microns. In accordance with the present invention, such a limitation is overcome by use of the energy converter 16. This latter device is arranged to receive electromagnetic energy of wavelengths longer than those to which the photocathode 22 is sensitive and to emit, in response thereto, electromagnetic energy at a wavelength to which the photocathode 22 is normally usefully sensitive. Moreover, the energy converter 16 is arranged to be susbstantially optically transparent to radiation wavelengths within the sensitivity range of the photocathode in order to take full advantage of the overall information gathering capabilities of the photodetection device 10.

Figure 2:
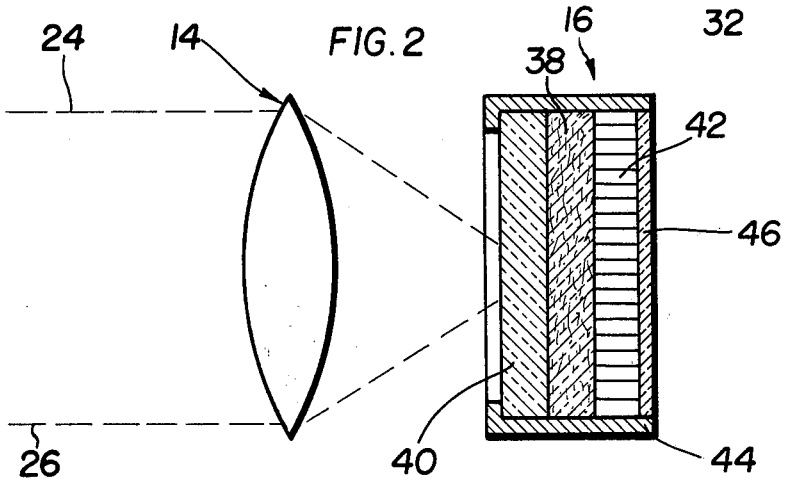
FIG. 2 is a central sectional view of an energy converter constructed for use in the photodetection apparatus of FIG. 1.

In the specific instance wherein it is desired to employ an S-20 photocathode while deriving information from incident infrared laser light at a wavelength of 1.06 microns, the energy converter 16 of the invention is constructed as illustrated in FIG. 2. There, a layer 38 of emitting material is sandwiched between an optically transparent window 40 and a fiber optics disc 42. These three elements are then hermetically sealed in a container 44. An eminently useful material for the layer 38 is a polycrystalline lanthanum neodymium chloride prepared from a melt by vapor deposition and having the typical formula of $La_{1-x}\ Nd_x\ Cl_3$ wherein $x$ varies between 0.01 and 1.0. A preferred form of this salt has the formula $La_{0.8}\ Nd_{0.2}\ Cl_3$. This preferred material absorbs radiation in the 1.06 micron wavelength region and re-emits at the 0.873 micron wavelength region, the latter wavelength being within the useful spectral sensitivity of an S-20 photocathode. Advantagously, a dielectric filter 46 is disposed axially rearwardly of the fiber optics disc 42 and generally between the incident rays and the faceplate of the image intensifier tube 12. The dielectric filter 46 is fabricated from such materials as thorium oxide and silicon oxide in order to block the passage of 1.06 micron radiations which are not absorbed in the emitting material of layer 38 while passing electromagnetic energy radiations of shorter wavelengths.

As will be appreciated from the foregoing descriptions, the present invention employs a material for the layer 38 which absorbs electromagnetic radiation at one wavelength and re-emits it at a shorter wavelength. Most materials that absorb and re-radiate energy re-radiate at wavelengths which are longer than those absorbed. As a consequence, only certain materials are useful for layer 38 in the present invention.

In the material preferred for the 1.06 micron incident radiations, it is specified that, for each neodymium atom, there are four lanthanum atoms and 15 chloride atoms; and for electrical balance, both the neodymium and lanthanum atoms exist in the +3 oxidation state, that is, the state in which three electrons are missing from the atomic configuration. The neodymium atoms form the active media for energy conversion while the lanthanum and chloride atoms form an inert host. The preferred lanthanum neodymium chloride is hygroscopic and must be protected from atmospheric moisture by hermetic sealing in the container 44.

In operation of the photodetection apparatus 10, image intensifier tube 12 functions in the conventional manner; and in addition, the incident 1.06 micron wavelength radiation is absorbed in the active material of layer 38 and has been found to induce a transition from the Y level or second highest energy state of the neodymium atoms to the R level, ambient temperatures developing useful populations in the Y level for purposes of the present invention. A subsequent transition to the S level may be induced by thermal interaction with the atomic lattice, by energy matches between the higher level energy states and the 1.06 micron wavelength radiations and by ion-ion interaction. The excited states, i.e. those normally unoccupied when the system is in thermal equilibrium, eventually relax to the ground state or Z level emitting energy in the form of photons and phonons, the emitted photons comprising the output signal of layer 38 to be coupled to the photocathode 22. The present system is unusual in that the emitted photons are of shorter wavelength and therefore greater energy than the exciting radiation.

It will be appreciated that many hosts for the active converter material may be employed; and it has been found that energy absorption and fluorescence of neodymium occurs in such hosts as silica glass, yttrium aluminum garnet, calcium fluoride, yttrium aluminum oxide and others. Furthermore, certain other rare earths may be employed as the active material in addition to neodymium; and these include salts of praseodymium, holmium, erbium, and dysprosium.

The present invention also contemplates that the energy converting layer 38 may, where required, additionally include minor amounts of compounds of such transition metals as iron and yttrium in the positively charged, trivalent or divalent state. These "active impurities" coact in the transfer of energy in the primary active material, the rare earth atoms. The included minor quantities of such transition metal compounds absorb energy and then transfer it to the rare earth atoms which then re-emit the energy at a shorter wavelength as described hereinabove.

Figure 3:
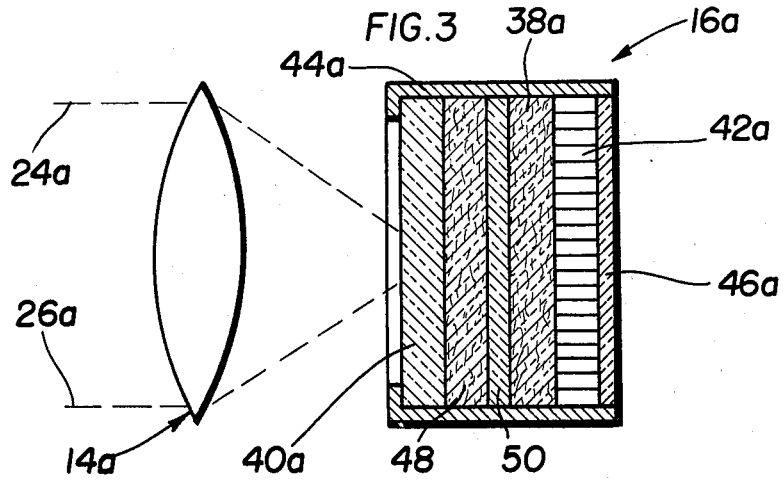
FIG. 3 is a modified form of the energy converter of the invention.

In order that the principles of the present invention may be fully understood, a modified form of the energy converter is illustrated in FIG. 3, like numerals having been used to designate like parts with the suffix letter "*a*" being employed to distinguish those elements associated with the embodiment of FIG. 3. The energy converter **16*a* of FIG. 3 is characterized by the inclusion of a second layer 48 incorporating emitting material as well as a corresponding dielectric filter 50. The layer 48 employs holmium in the +3 oxidation state contained in a suitable host substance. The activity of the holmium atoms in the layer 48 is similar to that of the neodymium atoms in the layer 38 except that the former absorb incident radiation at the 1.65 micron wavelength and emit converted electromagnetic energy at a second, shorter wavelength. Cooperatively, the dielectric filter 50** is arranged to block unabsorbed radiations at the 1.65 micron wavelength level and to pass shorter wavelengths.

The drawing and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated in the following claims.

The invention claimed is as follows:

1. Photodetection apparatus comprising: photosensitive means usefully responsive to electromagnetic energy in a first wavelength region; passive energy conversion means for receiving electromagnetic energy of a wavelength longer than said first wavelength region and in a region to which said photosensitive means is insensitive and emitting electromagnetic energy in said first wavelength region in response thereto, said energy conversion means being substantially optically transparent to radiations in said first wavelength region; and means optically coupling said energy conversion means to said photosensitive means, whereby said photosensitive means provides information concerning incident electromagnetic energy in both said first wavelength region and at said longer wavelength.

2. Photodetection apparatus according to claim 1 wherein said photosensitive means comprises an image intensifier tube.

3. Photodetection apparatus according to claim 1 wherein said energy conversion means includes a substance that emits electromagnetic energy of shorter wavelength than the wavelength of an incident electromagnetic energy; and a carrier material for said substance.

4. Photodetection apparatus according to claim 3 wherein said substance is a salt of a rare earth.

5. Photodetection apparatus according to claim 4 wherein said rare earth is neodymium.

6. Photodetection apparatus according to claim 4 wherein said rare earth is holmium.

7. Photodetection apparatus according to claim 3 wherein said carrier material includes yttrium aluminum garnet.

8. Photodetection apparatus according to claim 3 wherein said carrier material is lanthanum chloride.

9. Photodetection apparatus according to claim 3 wherein said energy conversion means further includes a compound of a transition metal selected from the class consisting of iron and yttrium.

10. Photodetection apparatus according to claim 1 wherein said apparatus further includes housing means for said energy conversion means.

11. Photodetection apparatus according to claim 1 which further includes second energy conversion means for receiving electromagnetic energy of a second, different wavelength and emitting electromagnetic energy in said first wavelength region.

12. Photodetection apparatus according to claim 1 which further includes optical filter means disposed between said photosensitive means and said energy conversion means for blocking electromagnetic energy of said longer wavelength and for transmitting energy of said first wavelength region.

* * * * *